United States Patent [19]

Antonova et al.

[11] 4,083,402

[45] Apr. 11, 1978

[54] METHOD OF UNDERGROUND GASIFICATION OF A COAL BED

[76] Inventors: Roza Ivanovna Antonova, Chongarsky bulvar, 10, korpus 1, kv. 41; Efim Vulfovich Kreinin, ulitsa Chugunnye vorota, 21, korpus 3, kv. 69, both of Moscow, U.S.S.R.

[21] Appl. No.: 658,779

[22] Filed: Feb. 17, 1976

[30] Foreign Application Priority Data

Apr. 2, 1975 U.S.S.R. ..... 2115205(I)

[51] Int. Cl.[2] ..... E21B 43/24

[52] U.S. Cl. ..... 166/251; 48/DIG. 6; 166/256

[58] Field of Search ..... 166/251, 256, 259; 299/2, 6; 48/DIG. 6

[56] References Cited

U.S. PATENT DOCUMENTS

| | | | |
|---|---|---|---|
| 947,608 | 1/1910 | Betts | 296/6 X |
| 2,973,811 | 3/1961 | Rogers | 166/251 |
| 4,024,914 | 5/1977 | Kreinin | 166/256 |

FOREIGN PATENT DOCUMENTS

| | | | |
|---|---|---|---|
| 697,189 | 9/1953 | United Kingdom | 48/DIG. 6 |

OTHER PUBLICATIONS

Nusinov, Subterranean Galification of Coal, *Canadian Chemistry and Process Industries,* June, 1946, pp. 29–32.

Sellers, Gasification of Coal Underground, *The Gas World,* Feb. 1947, pp. 217–219.

*Primary Examiner*—Stephen J. Novosad
*Assistant Examiner*—George A. Suchfield
*Attorney, Agent, or Firm*—Lackenbach, Lilling & Siegel

[57] ABSTRACT

To control the process of underground gasification of a coal bed with due provisions for the natural geological and mining conditions, in the disclosed method the rate of gassing-out the coal bed is selected from the following expression:

$$I = \frac{W}{0.506\left(\frac{Q_H^r \cdot V^r}{Q_H^p}\right)^{-1.9} m\left(0.702 - 0.659\frac{Q_H^r \cdot V^r}{Q_H^p}\right)}$$

where

W is the amount of water flowing into the gasification zone, $m^3$/hour;

I is the amount of coal gassed out per unit of time, tons/hour (the intensity of the process);

$Q_h^r$ is the combustion heat of the gas, kcal/$m^3$;

$v^r$ is the yield of gas from 1.0 kg of coal, $m^3$;

$Q_h^p$ is the lowest combustion heat of coal, kcal/kg;

*m* is the thickness of the coal bed, in meters.

1 Claim, 3 Drawing Figures

METHOD OF UNDERGROUND GASIFICATION OF A COAL BED

The present invention relates to the art of underground gasification of coal beds, particularly, by mineless gassing out of such beds.

There is known and employed a method of underground gasification of coal beds, including drying in advance and then gassing out or gasifying the bed in situ by supplying an oxidant to the incandescent surface of the coal through a system of blow-in wells and withdrawing the products of gasification via a system of withdrawal wells (see, for example, "Underground Gazification of Coal" by P. V. Skafa, 1960, p. 210).

To perform this known method of gasification, vertical and inclined blow-in wells are drilled to the gas bed and withdrawal wells are drilled through the bed.

A shortcoming of the known method of gasification of coal beds is the fact that it fails to ensure the stability of conducting the process at an adequately high energy-wise level (with the efficiency factor equalling at least 0.6), should the natural conditions of the coal bed, such as its thickness, the quality of the coal and the rate of water inflow to the underground gas generator vary. The process of gasification is practically uncontrollable, since insofar there have been developed no patterns according to which the intensity of supplying the blowing agent would be related to the rate of water inflow into the underground gasification zone, to the thickness of the coal bed and to the quality of the coal.

Thus, in the Kuznetsk mining field, where 2 meters thick coal beds are gasified, in one case the process is stable, characterized by a high energy-wise level with the efficiency factor as high as 0.6 to 0.7, which corresponds to the combustion heat of the gas in a range from 1,000 to 1,100 kcal/m$^3$, whereas in another case the combustion heat of the gas obtained is short of 760 kcal/m$^3$ and even of 450 kcal/m$^3$, with the efficiency factor being about 0.5; in still another case the process fails altogether (see Table D hereinbelow).

The main cause of insufficient efficiency is the duty of gasification being such that the intensity of a blowing-in the blowing agent, i.e. the oxidant, is unrelated to the rate of water inflow and the thickness of the bed.

In the abovementioned first case the water inflow to the zone of gasification averages 2 m$^3$/hour, while in the abovementioned second cases it equals 4 m$^3$/hour, whereas the intensity of the process (that is, the rate of gasification) in both cases is the same, equalling approximately 2 tons/hour. Thus, in the second-mentioned case the main cause of the affected efficiency of the process is the inadequately high rate of the process. As can be seen from the same Table D hereinbelow, with the intensity of the gasification process stepped up to 4 tons/hour, the combustion heat of the gas obtained rises to 1,100 kcal/m$^3$ with the water inflow at 4 m$^3$/hour.

Table 1

| Water Inflow W = 2 m$^3$/hour | | Water Inflow W = 4 m$^3$/hour | |
|---|---|---|---|
| Combustion Heat of Gas, kcal/m$^3$ /$Q_H^r$/ | Intensity of Gasification, tons/hour /I/ | Combustion Heat of Gas, kcal/kg /$Q_H^r$/ | Intensity of Gasification, tons/hour /I/ |
| 1100 | 1.0 | 760 | 2.0 |
| 900 | 1.95 | 760 | 2.05 |
| 1090 | 2.20 | 740 | 1.95 |
| 900 | 1.80 | 750 | 2.00 |
| 1100 | 2.10 | 760 | 2.20 |
| 980 | 2.05 | 750 | 2.10 |
| 970 | 1.90 | 651 | 2.15 |

Table 1-continued

| Water Inflow W = 2 m$^3$/hour | | Water Inflow W = 4 m$^3$/hour | |
|---|---|---|---|
| Combustion Heat of Gas, kcal/m$^3$ /$Q_H^r$/ | Intensity of Gasification, tons/hour /I/ | Combustion Heat of Gas, kcal/kg /$Q_H^r$/ | Intensity of Gasification, tons/hour /I/ |
| 980 | 1.85 | 698 | 2.1 |
| 970 | 1.90 | 500 | 2.20 |
| 1000 | 2.00 | 450 | 2.05 |
| | | 1100 | 4.00 |
| | | 1050 | 4.10 |
| | | 1100 | 4.20 |

It is an object of the present invention to create a method of underground gasification of a coal bed, providing for utilizing the energy of the coal being gasified to a high degree of effectiveness.

It is another object of the present invention to create a method of underground gasification of a coal bed, which should take into account the thickness of the coal bed being gasified, for the rate of water inflow to the gasification zone and for the quality of the coal, i.e. for the natural conditions in the gasification area, in an optimal and rational way.

It is still another object of the present invention to create a method of underground gasification of a coal bed, which should step up considerably the effectiveness of the process without any additional expenses for extra production equipment and without introducing any new technology.

These and other objects are attained in a method of underground gasification of a coal bed, including drying in advance the coal bed and gassing it out by supplying a blowing agent to the incandescent surface of the coal through a system of blow-in wells and withdrawing the products of gasification through a system of gas withdrawal wells, in which method, in accordance with the present invention, the rate of said gassing-out of the coal bed is selected to correspond to the natural conditions, such as the thickness of the coal bed ($m$), the quality of the coal and the water inflow (W) to the gasification zones, the process being carried out according to the following expression:

$$I = \frac{W}{0.506\left(\frac{Q_H^r \cdot V^r}{Q_H^y}\right)^{-1.9} m\left(0.702 - 0.659\frac{Q_H^r \cdot V^r}{Q_H^y}\right)}$$

where

W is the amount of water flowing into the gasification zone, m$^3$/hour;

I is the amount of coal gassed out per unit of time, tons/hour (the intensity of the process);

$Q_h^r$ is the combustion heat of the gas, kcal/m$^3$;

$v^r$ is the yield of gas from 1.0 kg of coal, m$^3$;

$Q_h^y$ is the lowest combustion heat of coal, Kcal/ks;

$m$ is the thickness of the coal bed, in meters.

The above features provide, nd that without any additional expenses for costly new apparatus and new technology, for stepping up considerably the combustion heat value of fuel gas obtained by underground gasification of a coal bed, with aid of controlling the process at its optimal duty according to the abovespecified empirical formula suggesting the best duty of conducting the process of gasification at different and varying mining and geological conditions.

According to an embodiment of the invention, the said drying in advance is conducted until the specific water inflow rate is reduced to at least 3.0 m$^3$/hr. m$^3$/t, whereafter the abovespecified rate of gassing out the bed, according to the said formula, is set and maintained.

In this preferred embodiment of the invention there is specified the degree of the drying operation conducted in advance of gasification, which renders the control of the process of underground gasification in accordance with the above formula both practical and convenient.

The herein disclosed method of gasification of a coal bed will be further described in connection with an embodiment thereof, with reference being had to the accompanying drawings, wherein.

Figure 3:
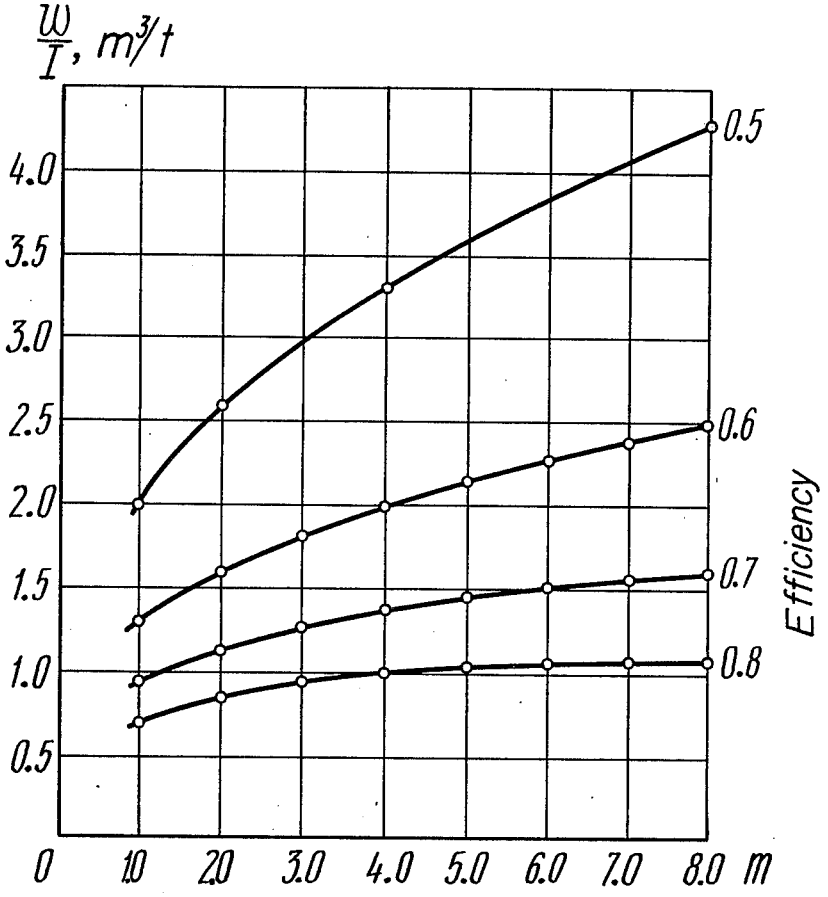

FIG. 3 presents the curves illustrating the relationship between W/I and *m*.

In the drawings:

1 is the vertical blow-in well (the same well is used for igniting the bed);
2 — inclined blow-in well;
3 — gas withdrawal (escape) well;
4 — coal bed;
5 — surrounding rock;
6 — gassed-out space;
7 — wells for pumping water from the gassed-out space;
8 — wells for pre-drying the coal bed.

Figure 1:
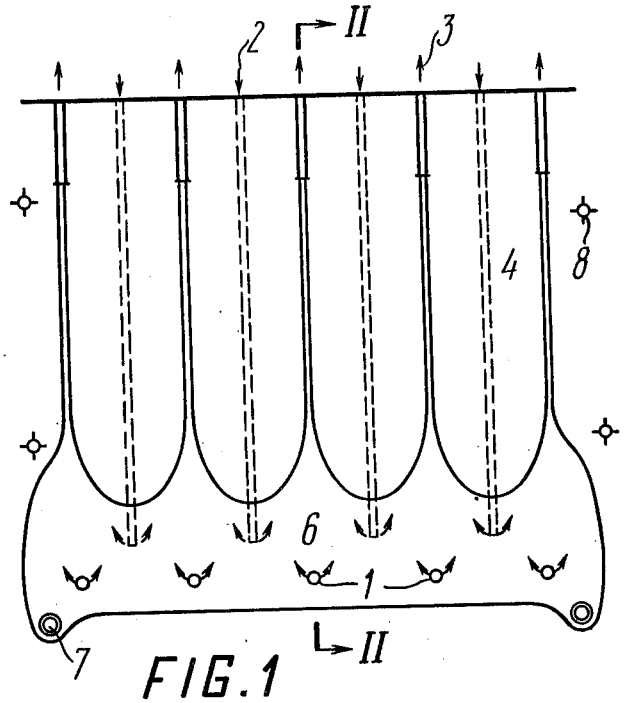
FIG. 1 illustrates schematically the operation of underground gasification of a coal bed.
Figure 2:
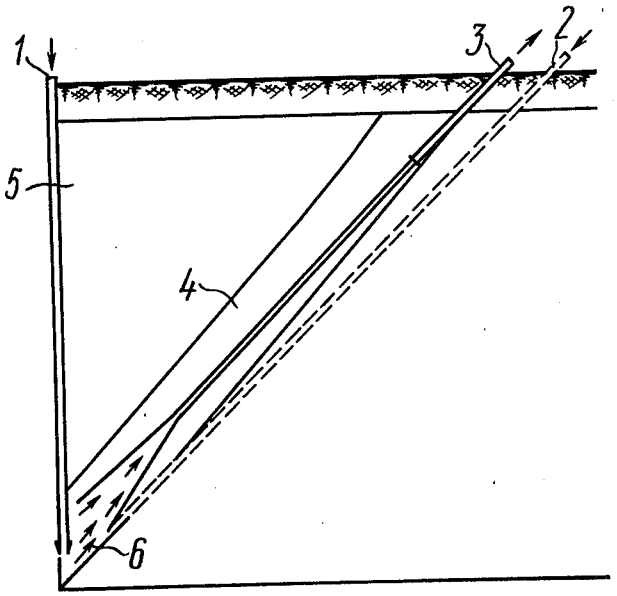
FIG. 2 is a sectional view taken along the line II - II of FIG. 1.

As is illustrated in FIGS. 1 and 2, vertical wells 1 and inclined wells 2 are drilled to perform underground gasification of a coal bed 4, and gas withdrawal or escape wells 3 are drilled through the coal bed 4. Water is pumped before the start of gasifiction from the wells 8 and during the process of gasification from the gassed-out space 6 via wells 7.

To control the process of underground gasification, it is possible, e.g. to vary the position of the gate valves in the blow-in wells, to maintain the preset calculated rate of gassing-out. This rate of gassing-out, in accordance with the present invention, is determined from the expression:

$$I = \frac{W}{0.506\left(\frac{Q_H^r \cdot V^r}{Q_H^y}\right)^{-1.9} m\left(0.702 - 0.659\frac{Q_H^r \cdot V^r}{Q_H^y}\right)}$$

wherein

W is the amount of water flowing into the gasification zone, $m^3$/hour;
I is the amount of coal gassed out per unit of time, tons/hour (the intensity of the process);
$Q_h^r$ is the combustion heat of the gas, kcal/kg;
$v^r$ is the yield of gas from 1.0 kg of coal, $m^3$;
$Q_H^y$ is the lowest combustion heat of coal, kcal/$m^3$;
*m* is the thickness of the coal bed, in meters.

However, with the water flow-in rate in excess of a permissible value (3$m^3$/t), as experience has shown, it is quite difficult to control the process to maintain the rate of gassing-out of the coal, according to the above expression.

The herein disclosed relationship (refer also to FIG. 3 of the drawings) is an outcome of several years of experience of performing underground gasification of coal beds under various mining and geological conditions, with various rates of gassing-out.

According to the disclosed relationship, it is possible to preset an optimal duty (I) of conducting the process of underground gasification, with provisions from the value of water inflow (W) to the gasification zone, for the thickness (*m*) of the coal bed and for the quality of coal.

Reducing the water inflow (W) to the underground gas generator by drying in advance to a value of at least 3$m^3$/t is necessary to create the water conditions permitting to start and conduct the fire work in the underground gas generator, so as to create initial gasification channels and to develop them to a size allowing for performing the process of gasification at a high rate, with production of high-quality gas having the required energy ratings.

With a great specific water inflow to the underground gas generator, the creation and development of the initial gasification channels is impaired, and more often than not made althogether impossible, on account of the combustion zone becoming drowned.

As an example of practical employment of the herein disclosed relationship, there will be hereinbelow described the experience of conducting the process of underground gasification at one of the stations operated by Podzemgas, where 8 meters and 2 meters thick coal bed were gasified.

Following the pre-drying of the gas generator, the inflow of subsoil water to the initial channel of gasification was about 5 $m^3$/hour. By employing the above relationship (1), there were calculated the optimal duties, i.e. the optimal rates of gasification in terms of the rates of supply of the blow-in agent to the gasification zone for the 8 meters and 2 meters thick beds.

In case of the 8 meter thick bed, with the efficiency factor of gasification at 0.6, the rate of gasification was set to be 2.0 tons/hour, while in case of the 2 meters thick bed the rate of gasification was set to be 3 tons/hour. In both cases the combustion heat of the gas produced by the generators was 1,000 kcal/$m^3$.

With the subsequent development of the front of the fire and expansion of the gas generator to 100 m along the coal bed, the water inflow to the gas generator amounted to about 20 $m^3$/hour. In this case, according to the disclosed relationship (1) the rate of gasification had to be stepped up to 7.4 tons/hour for the 8 m thick bed and to 12.3 tons/hour for the 2 m thick one.

When the process of gasification was conducted at the specified rates, the process was stable and at a high energy-wise level, with the efficiency factor of 0.62 and with the combustion heat of the gas at 1,000 kcal/$m^3$. Therefore, it can be seen that the herein disclosed method of underground gasification of coal produces gas with a higher combustion heat value and conducts the process of gasification at a high energy-wise level, without additional expenses of extra equipment and new technology.

To check up whether the herein disclosed method of underground gasification of a coal bed is really being performed, it is sufficient to determine the coal quality parameters ($Q_H^y$), the thickness of the coal bed (*m*), the amount of water flowing into the gasification zones (W), the quality of the gas being produced ($Q_H^r$) and the specific yield of the latter ($V^r$). Then there is determined the rate of blowing-in into the gas generator, corresponding to the determined rate (I) of gassing out the coal. And finally, by introducing the values obtained into the herein disclosed relationship (1), it is possible to determine whether the duty suggested by the present invention is maintained.

What we claim is:

1. In an improved method of underground gasification of a coal bed, the improvement which comprises the steps of dewatering or drying in advance the coal bed until the specific flow of water to said coal bed is reduced to a value of at least 3.0 $m^3/t$, by pumping said water out via a first series of wells, gassing out the coal by supplying a blowing agent to the incandescent surface of coal through a system of blow-in wells, withdrawing the products of gasification through a system of gas withdrawal wells while continuing said dewatering step by pumping said water, from the gassed-out space created during said gasification, via a second series of wells, and optimizing the gassing-out of said coal bed at a rate selected in accordance with the following expression:

$$I = \frac{W}{0.506\left(\frac{Q_H^r \cdot V^r}{Q_H^y}\right)^{-1.9}_{m}\left(0.702 - 0.659\,\frac{Q_H^r \cdot V^r}{Q_H^y}\right)}$$

where

W is the amount of water flowing into the gasification zone, $m^3$/hour;

I is the amount of coal gassed out per unit of time, tons/hour (the intensity of the process);

$Q_H^r$ is the combustion heat of the gas, kcal/$m^3$;

$v^r$ is the yield of gas from 1.0 kg. of coal, $m^3$;

$Q_H^y$ is the lowest combustion heat of coal, kcal/kg;

$m$ is the thickness of the coal bed, in meters; whereby control and stabilization of the method of underground gasification of a coal bed is more practical and convenient.

* * * * *